US008297219B2

(12) United States Patent
Chen

(10) Patent No.: US 8,297,219 B2
(45) Date of Patent: Oct. 30, 2012

(54) SPRAY APPARATUS AND COATING SYSTEM USING SAME

(75) Inventor: Hsiang-Hung Chen, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 271 days.

(21) Appl. No.: 12/770,744

(22) Filed: Apr. 30, 2010

(65) Prior Publication Data

US 2011/0192917 A1 Aug. 11, 2011

(30) Foreign Application Priority Data

Feb. 8, 2010 (TW) ..... 99103702 A

(51) Int. Cl.
*B05B 7/06* (2006.01)
*B05B 13/02* (2006.01)
*B05C 5/00* (2006.01)

(52) U.S. Cl. ..... 118/313; 118/315; 118/62; 118/63; 118/324; 239/294; 239/295

(58) Field of Classification Search ..... 118/300, 118/313–315, 324, 325, 58, 62, 63; 239/294, 239/295, 290; 427/421.1, 424, 427.1
See application file for complete search history.

(56) References Cited

U.S. PATENT DOCUMENTS

| | | | | |
|---|---|---|---|---|
| 5,418,009 | A * | 5/1995 | Raterman et al. | 427/207.1 |
| 5,720,820 | A * | 2/1998 | Boger et al. | 118/669 |
| 6,749,688 | B2 * | 6/2004 | Tateyama et al. | 118/667 |
| 2008/0000374 | A1 * | 1/2008 | Kim et al. | 101/425 |

* cited by examiner

*Primary Examiner* — Yewebdar Tadesse
(74) *Attorney, Agent, or Firm* — Altis Law Group, Inc.

(57) ABSTRACT

An exemplary spray apparatus includes a first nozzle assembly and a second nozzle assembly, which are parallel to each other. The first nozzle assembly includes a plurality of feed inlets and a feed outlet in communication with the feed inlets. The first nozzle assembly configured for spraying a liquid coating material on a substrate. The feed inlets are aligned along a first imaginary straight line. The second nozzle assembly includes a plurality of air inlets and an air outlet in communication with the air inlets. The second nozzle assembly is configured for spraying air with uniform air toward the liquid coating material applied on the substrate. The air inlets are aligned along a second imaginary straight line parallel with the first imaginary straight line.

14 Claims, 3 Drawing Sheets

SPRAY APPARATUS AND COATING SYSTEM USING SAME

BACKGROUND

1. Technical Field

The present disclosure relates to a spray apparatus and a coating system using the spray apparatus.

2. Description of Related Art

There are many coating methods used to apply a liquid material to a substrate to form a film product, for example, reverse gravure coating, reverse roll coating. Reverse gravure coating is where an engraved roller is immersed in a tank of coating material, and the coating material fills engravings or slits in the engraved roller. The coating material is dropped on the substrate as the substrate passes between the engraved roller and a pressure roller, and excess material is removed by a doctor blade. With reverse roll coating, the coating material is measured onto one application roller and a coating material is brushed off the application roller by a substrate as it passes around a bottom support roller.

In these methods, however, the roll pressure, and the type and angle of the doctor blade influence the deposition of the coating material, and these coating methods employ complicated structures, therefore uniformity of the film product is difficult to control.

BRIEF DESCRIPTION OF THE DRAWINGS

Many aspects of the present spray apparatus and coating system using the spray apparatus can be better understood with reference to the following drawings. The components in the drawings are not necessarily drawn to scale, the emphasis instead being placed upon clearly illustrating the principles of the present spray apparatus and coating system. Moreover, in the drawings, like reference numerals designate corresponding parts throughout the several views.

DETAILED DESCRIPTION

Figure 1:
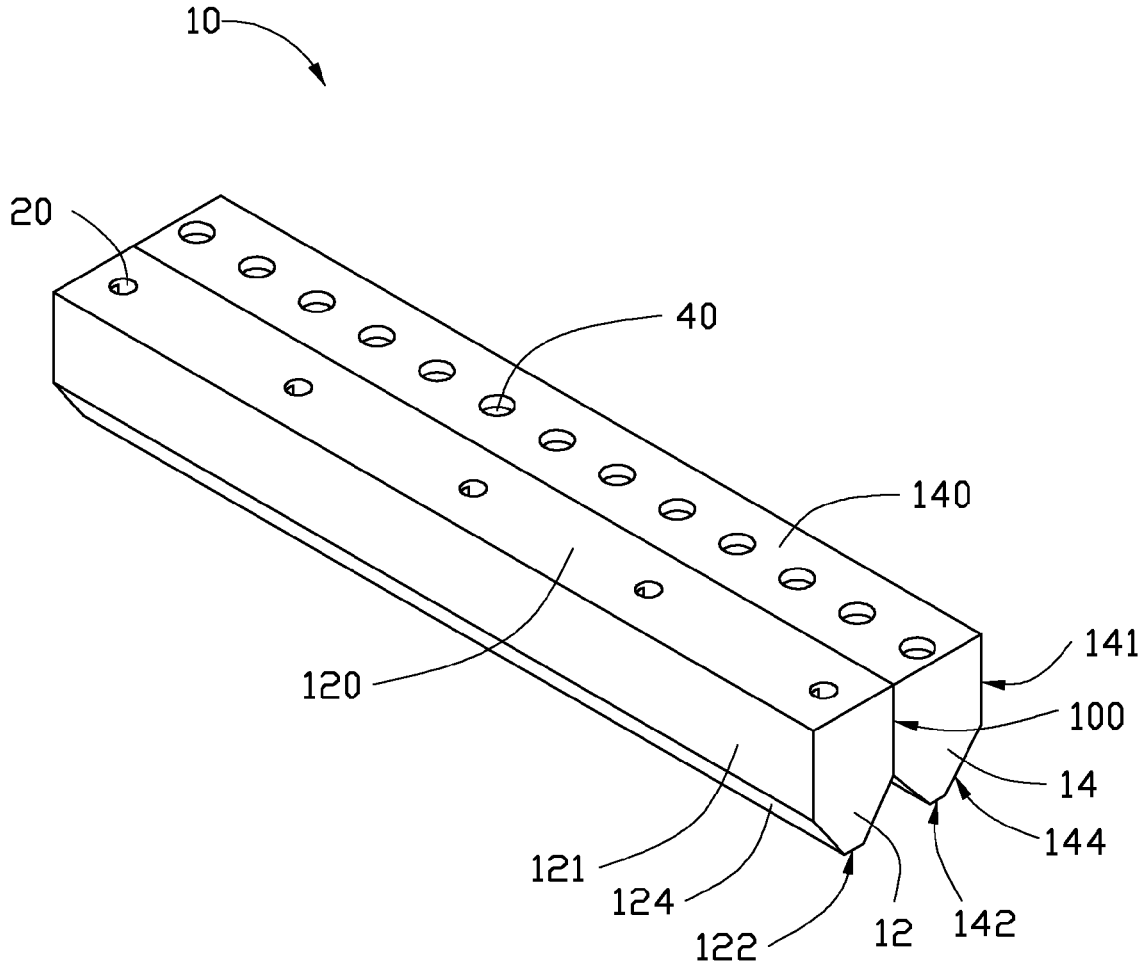
FIG. 1 is an isometric view of a spray apparatus in accordance with a first exemplary embodiment.
Figure 2:
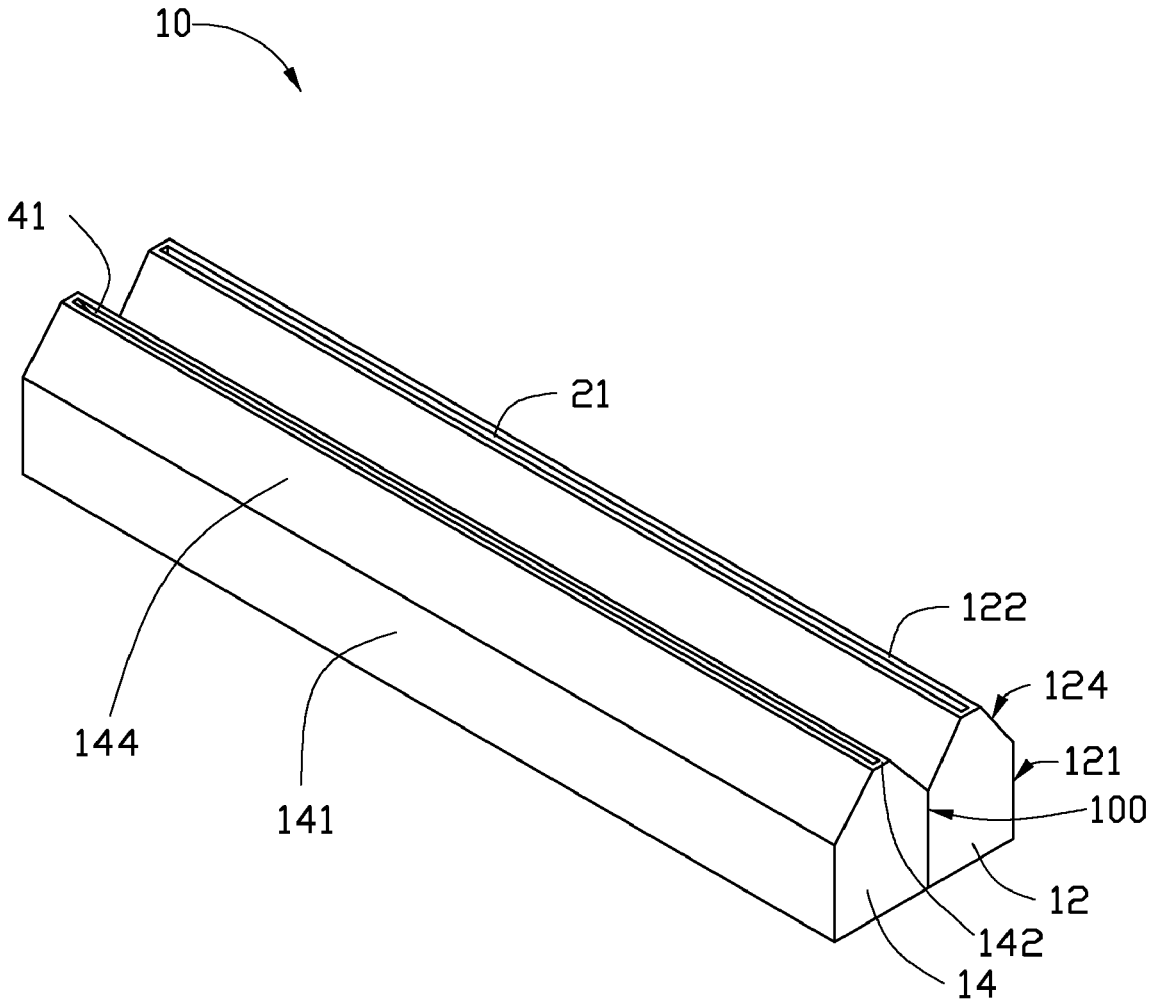
FIG. 2 is similar to FIG. 1, but rotated 180 degrees.

FIG. 1 and FIG. 2 show a spray apparatus 10 in accordance with a first embodiment. The spray apparatus 10 includes a first nozzle assembly 12 and a second nozzle assembly 14. The first nozzle assembly 12 and the second nozzle assembly 14 are juxtaposed and attached to each other at a public side 100. The first nozzle assembly 12 has a top side 120, a first side 121 parallel to the public side 100, a second side 124, and a bottom side 122. The second side 124 inclines to a central axis of the first nozzle assembly 12 relative to the first side 121, thus the bottom side 122 is narrower than the top side 120. There is a plurality of feed inlets 20 defined in the top side 120 arranged along a first imaginary straight line parallel to the extending direction of the first nozzle assembly 12. There is a feed outlet 21 defined in the bottom side 122. The feed outlet 21 is a slot interconnected with all the feed inlets 20 and extending along the direction of the first imaginary straight line. The first nozzle assembly 12 is configured to spray a liquid coating material on a substrate and the feed outlet 21 guides the liquid coating material to drop perpendicularly to the substrate. Each feed inlet 20 is a hole directly connected to the feed outlet 21. The liquid coating material applied in the first nozzle assembly 12 can be changed to colloid material.

The second nozzle assembly 14 is configured to spray air toward the liquid coating material to blow the coating material uniformly. The air is uniform in pressure. The second nozzle assembly 14 has a top side 140, a first side 141 parallel to the public side 100, a second side 144, and a bottom side 142. The second side 144 inclines to a central axis of the second nozzle assembly 14 relative to the first side 141, thus the bottom side 142 is narrower than the top side 140. There is a plurality of air inlets 40 defined in the top side 140 arranged along a second imaginary straight line parallel to the first imaginary straight line. There is an air outlet 41 defined in the bottom side 142. The air outlet 41 is a slot interconnected with the air inlets 40 along the direction of the second imaginary straight line. Each air inlet 40 is a hole directly connected to the air outlet 41. The number of the air inlets 40 is greater than that of the feed inlets 20. Each feed inlet 20 is aligned with the respective nearest air inlet 40 along a direction perpendicular to the first imaginary straight line. Remaining air inlets 40 not aligned to any feed inlet 20 can further blow the coating material to be more uniform. The air outlet 41 is parallel to the feed outlet 21. Because the dropping direction of the coating material is guided by the feed outlet 21, and the blowing direction of the air is guided by the air outlet 41, the dropping direction of the coating material is parallel to the blowing direction of the air.

In order to make the air pressure more uniform, a porous material 412 (shown in FIG. 3) is located inside the second nozzle 12. The airflow rate gets slower and the pressure more uniform when the air flows through the porous material 412.

The first nozzle assembly 12 and the second nozzle assembly 14 are independent of and parallel to each other, other than being attached at the public side 100. The number of the feed inlets 20 and the air inlets 40 can be one.

Figure 3:
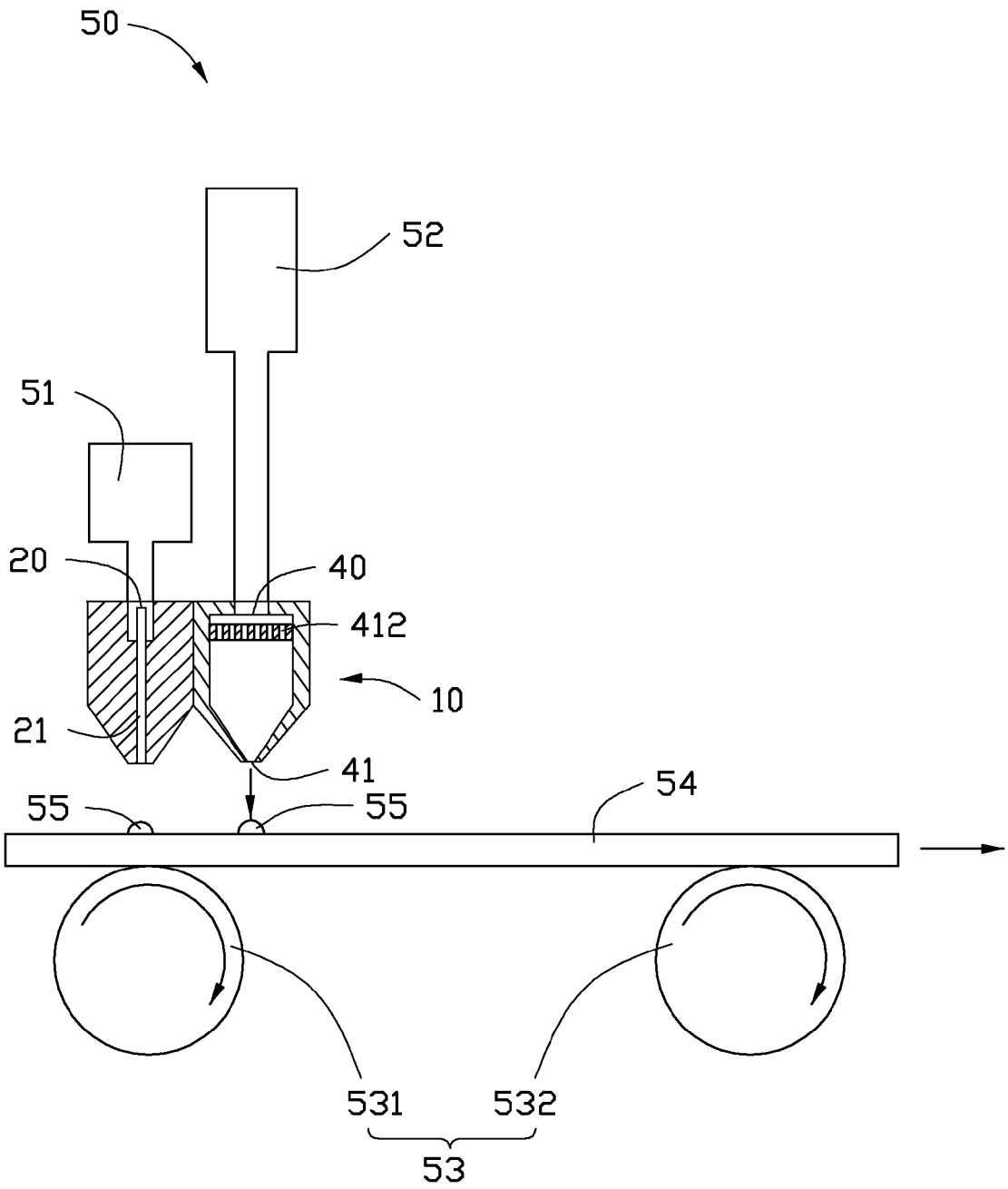
FIG. 3 is a coating system in accordance with a second exemplary embodiment.

FIG. 3 shows a coating system 50 in accordance with a second embodiment. The coating system 50 includes the spray apparatus 10, a coating material feeding device 50, an air blowing device 52, and a conveyor 53. The coating material feeding device 50 is coupled to the feed inlet 20. The air blowing device 52 is coupled to the air inlets 40. The coating material feeding device 50 can also have a lot of pipes interconnected to each feed inlet 20. The air blowing device 52 can also have a lot of pipes interconnected to each air inlet 40.

The conveyor 53 includes at least a first wheel 531 and a second wheel 532 for supporting and transporting a substrate 54. The substrate 54 is laid on the first wheel 531 and the second wheel 532. The substrate 54 is flexible or hard, and a film product is formed on the substrate 54. The substrate 54 is moved at a constant rate as the first wheel 531 and the second wheel 532 rotate.

The coating material 55 is dropped on the substrate 54 from the feed outlet 21. The coating material dropped on the substrate will not be uniform spread, for example, the central area where the material drops will be thicker than the peripheral area. However, as the substrate 54 moves on, the coating material 55 just dropped moves to beneath the air outlet 42. The air blown by the second nozzle assembly 14 is oriented perpendicular to the substrate 54 and parallel to the dropping direction of the coating material 55. That is, the air blown by the second nozzle assembly 14 is aimed at the thick area. The coating material will thus be dispersed from the central area to the peripheral area until the coating material is under the same air pressure at every point, at that time, the coating material 55 on the substrate 54 stops dispersing and is of uniform thickness. It is noteworthy that the moving rate should guarantee the substrate 54 moves a distance L per unit time, and the distance L refers to the distance between the feed outlet 21 and the air outlet 41 in the moving direction of the substrate 54.

The spray apparatus 10 and the coating system 50 are simple in their structure. Because the blowing direction of the air can be oriented parallel to the dropping direction of the coating material 55 and perpendicular to the substrate 54, the coating material 55 is easily uniformly spread by the blowing air.

It is understood that the above-described embodiments are intended to illustrate rather than limit the disclosure. The variations may be made to the embodiments without departing from the spirit of the disclosure. Accordingly, it is appropriate that the appended claims be construed broadly and in a manner consistent with the scope of the disclosure.

What is claimed is:

1. A spray apparatus, comprising:

a first nozzle assembly, the first nozzle assembly having a plurality of feed inlets and a feed outlet in communication with the plurality of feed inlets, the first nozzle assembly configured for spraying a liquid coating material on a substrate, the plurality of feed inlets aligned along a first imaginary straight line; and a second nozzle assembly juxtaposed with the first nozzle assembly, the second nozzle assembly having a plurality of air inlets and an air outlet in communication with the plurality of air inlets, the second nozzle assembly configured for spraying air toward the liquid coating material applied on the substrate, the plurality of air inlets aligned along a second imaginary straight line parallel with the first imaginary straight line.

2. The spray apparatus according to claim 1, wherein a porous material is located inside the second nozzle assembly.

3. The spray apparatus according to claim 1, wherein the feed outlet is elongated and arranged along the first imaginary straight line.

4. The spray apparatus according to claim 3, wherein the air outlet is elongated and arranged along the second imaginary straight line.

5. The spray apparatus according to claim 1, wherein the first nozzle assembly and the second nozzle assembly are attached to each other.

6. The spray apparatus according to claim 1, wherein the number of the plurality of air inlets is greater than that of the plurality of feed inlets.

7. The spray apparatus according to claim 6, wherein the plurality of feed inlets are aligned with the respective nearest plurality of air inlets along a direction perpendicular to the first imaginary straight line.

8. A coating system, comprising:

a spray apparatus including:

a first nozzle assembly, the first nozzle assembly having a plurality of feed inlets and a feed outlet in communication with the plurality of feed inlets, the first nozzle assembly configured for spraying a liquid coating material on a substrate, the plurality of feed inlets aligned along a first imaginary straight line; and a second nozzle assembly juxtaposed with the first nozzle assembly, the second nozzle assembly having a plurality of air inlets and an air outlet in communication with the plurality of air inlets, the second nozzle assembly configured for spraying air toward the liquid coating material applied on the substrate, the plurality of air inlets aligned along a second imaginary straight line parallel with the first imaginary straight line;

a coating material feeding device coupled to the plurality of feed inlets;

an air blowing device coupled to the plurality of air inlets; and a conveyor configured for supporting and transporting the substrate.

9. The coating system according to claim 8, wherein a porous material is located inside the second nozzle assembly.

10. The coating system according to claim 8, wherein the feed outlet is elongated and arranged along the first imaginary straight line.

11. The coating system according to claim 10, wherein the air outlet is elongated and arranged alone the second imaginary straight line.

12. The coating system according to claim 8, wherein the first nozzle assembly and the second nozzle assembly are attached to each other.

13. The coating system according to claim 8, wherein the number of the plurality of air inlets is greater than that of the plurality of feed inlets.

14. The coating system according to claim 13, wherein the plurality of feed inlets are aligned with the respective nearest plurality of air inlets along a direction perpendicular to the first imaginary straight line.

* * * * *